US008398176B2

(12) United States Patent
Haroldsen et al.

(10) Patent No.: US 8,398,176 B2
(45) Date of Patent: Mar. 19, 2013

(54) ASPHALT MILLING ATTACHMENT WITH DEPTH CONTROL AND BIT ACCESS

(75) Inventors: J. Tron Haroldsen, Herriman, UT (US); Jeremy K. Nix, Provo, UT (US)

(73) Assignee: Asphalt Zipper, Inc., Pleasant Grove, UT (US)

( * ) Notice: Subject to any disclaimer, the term of this patent is extended or adjusted under 35 U.S.C. 154(b) by 357 days.

(21) Appl. No.: 12/792,933

(22) Filed: Jun. 3, 2010

(65) Prior Publication Data

US 2010/0308640 A1 Dec. 9, 2010

Related U.S. Application Data

(60) Provisional application No. 61/183,783, filed on Jun. 3, 2009.

(51) Int. Cl.

| | |
|---|---|
| ***E01C 19/26*** | (2006.01) |
| ***E01C 23/088*** | (2006.01) |
| ***E01C 23/12*** | (2006.01) |
| ***E21C 25/06*** | (2006.01) |
| *B25D 15/00* | (2006.01) |

(52) U.S. Cl. ..... 299/39.6; 299/36.1; 299/39.1; 299/39.4; 404/90; 404/128; 37/387

(58) Field of Classification Search ..... 299/39.6, 299/39.1, 36.1; 404/93; 125/3; 30/370
See application file for complete search history.

(56) References Cited

U.S. PATENT DOCUMENTS

| | | | | |
|---|---|---|---|---|
| 2,366,017 | A * | 12/1944 | Fortune | 30/370 |
| 4,646,853 | A * | 3/1987 | Sugden et al. | 175/94 |
| 4,723,867 | A * | 2/1988 | Wirtgen | 404/90 |
| 5,140,754 | A * | 8/1992 | Martenson | 30/390 |
| 5,382,084 | A * | 1/1995 | Diver et al. | 299/39.5 |
| 6,116,699 | A * | 9/2000 | Kaczmarski et al. | 299/39.5 |
| 6,247,757 | B1 * | 6/2001 | Cochran | 299/39.6 |
| 6,779,948 | B2 * | 8/2004 | Bruso | 405/128.75 |
| 7,036,252 | B2 * | 5/2006 | Haroldsen et al. | 37/468 |
| 7,398,719 | B2 * | 7/2008 | Peot et al. | 83/520 |
| 8,177,456 | B2 * | 5/2012 | Haroldsen | 404/94 |
| 2004/0148823 | A1 * | 8/2004 | Schenk | 37/466 |
| 2007/0116519 | A1 * | 5/2007 | Haroldsen | 404/94 |
| 2007/0164597 | A1 * | 7/2007 | Brown | 299/39.1 |

* cited by examiner

*Primary Examiner* — David Bagnell
*Assistant Examiner* — John Williams
(74) *Attorney, Agent, or Firm* — Madson IP, P.C.

(57) ABSTRACT

A milling attachment device has a rotating hood and provides both cutting depth control and bit access by rotating the rotating hood. The rotating hood is rotated by an actuating mechanism such as an extending cylinder, a slew drive, or drive rings. The rotating hood may also have a skid foot and/or a wheel to assist in the depth control. The milling attachment device may be connected to a host vehicle so that it can be maneuvered into position for milling or maintenance.

17 Claims, 12 Drawing Sheets

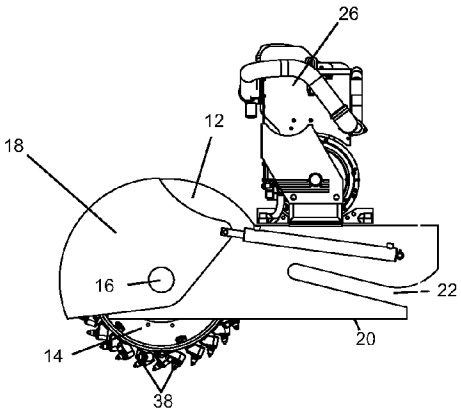
Figure 11c
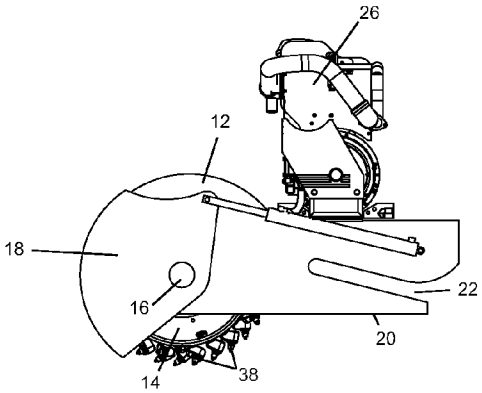
Figure 11b
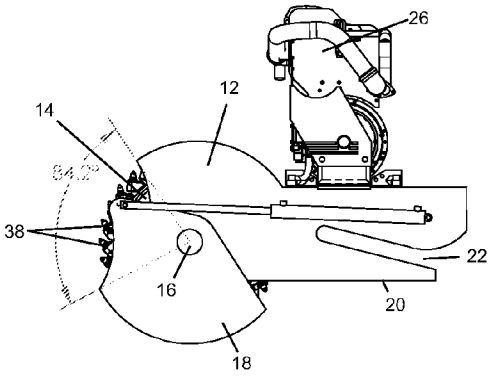
Figure 11a
Figure 11

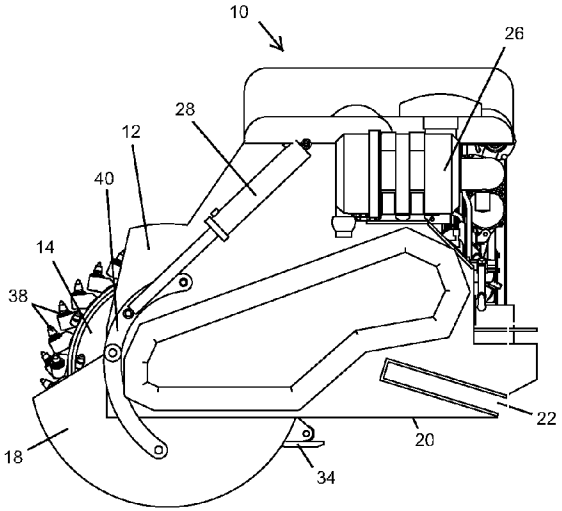
Figure 12c
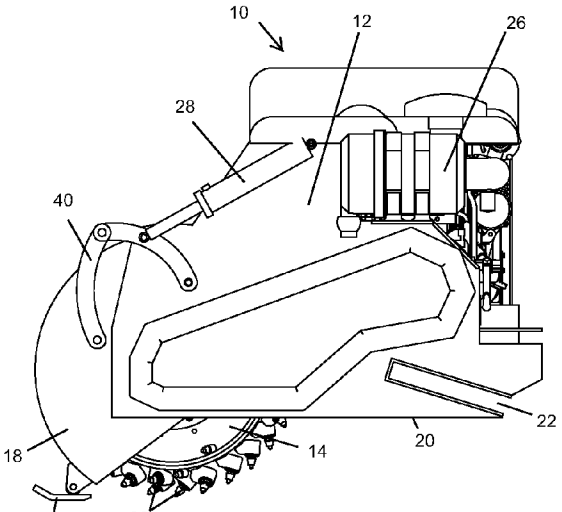
Figure 12b
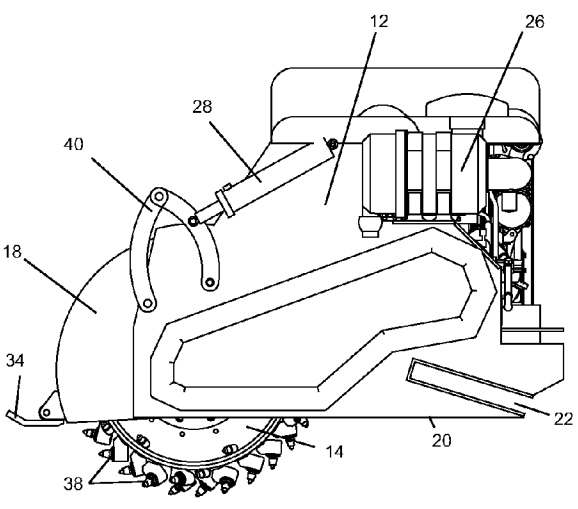
Figure 12a
Figure 12

ASPHALT MILLING ATTACHMENT WITH DEPTH CONTROL AND BIT ACCESS

BACKGROUND OF THE INVENTION

1. Field of the Invention

The present invention relates to systems and methods for milling asphalt. More specifically, the present invention relates to systems and methods that provide both depth control and bit access for an asphalt milling/trenching attachment.

2. The Relevant Technology

Portable asphalt milling attachments historically comprise two features. First, they have a way to control the depth that the milling attachment device cuts. Secondly, they have a way to facilitate the changing of bits mounted to a cutting wheel of the milling attachment device. Although both features are present on the milling attachment device, the features are accomplished using different device structure. In a few cases lacking a feature to facilitate the changing of bits, access to the cutting head to change the bits is only possible where the milling attachment device cutting head cuts on the bottom, requiring the lifting of the device to change bits.

Features facilitating the bit access in known devices typically expose only a very small area of the cutting head. This is because the feature interferes with the function of the depth control feature. Some equipment is designed so that the bit access feature can only be used with the depth control at a specific setting.

As a result, asphalt milling attachments utilize structure that adds complexity and cost. It is desirable to control depth of the cut and to also be able to repair or replace bits. However, it would be an advance in the art if both depth control and bit access could be accommodated by the same structure.

Accordingly, a need exists for a new system and method for providing depth control and bit access that is less complex and less expensive. Such systems and methods are disclosed herein.

BRIEF SUMMARY OF THE INVENTION

The present invention has been developed in response to the present state of the art, and in particular, in response to the problems and needs in the art that have not yet been fully solved by currently available asphalt milling/trenching attachments.

This invention combines the depth control and the bit access into one device. This can reduce the part count (simplify the device) and increase the area available to access the bits.

This invention may use a cover that rotates or moves transversely around a cutter head. When the cover is in the correct area, it allows control of the cutting depth. The cover may be rotated to expose the bits so that the bits can be accessed for maintenance. In some embodiments, the cover is also capable of lifting the cutting teeth off the ground so that no other devices are needed to hold the machine up to allow the cutting head to rotate freely to change bits.

The front of the machine could use a skid foot to contact the ground to maintain depth or it could use a wheel. The skid foot could be solid or it could pivot to follow the ground. It could use a combination of both.

The rotation of the cover can be controlled by a device that extends and retracts in a straight line. It could be electric, hydraulic or pneumatic. It could also be controlled by a device that uses a gear that is designed to rotate members around an axis (a slew drive or set of planetary drive rings, for example).

The axis of the cover could be the same as the axis of the cutting device or the two could be offset from each other. This could allow the cover to be closer to the cutter device where it contacts the ground and further away to let material out on the back.

The cover could also move transversely to allow the cover to perform both functions, namely depth control and bit access.

The attachment could use a bucket slot to allow a host vehicle to connect to it. It could alternatively use quick-connects (JRB style, skid steer or balderson style). Host vehicles for the attachment could include back hoes, loaders, excavators, track hoes, skid steers and the like.

The intended use of the attachment could be to cut asphalt, concrete or any other road construction/parking lot material. The attachment could also be used for soil stabilization. It could be used for full depth reclamation of roads. The cover could be outside the frame that holds the cutting device or it could be inside the frame that holds the cutting device. The attachment could be powered by the host vehicle or it could be self-powered with an engine or electric power.

These and other features of the present invention will become more fully apparent from the following description, or may be learned by the practice of the invention as set forth hereinafter.

BRIEF DESCRIPTION OF THE SEVERAL VIEWS OF THE DRAWINGS

In order that the manner in which the above-recited and other features and advantages of the invention are obtained will be readily understood, a more particular description of the invention, briefly described above, be rendered by reference to specific embodiments thereof which are illustrated in the appended drawing(s). Understanding that these drawings depict only typical embodiments of the invention and are not therefore to be considered to be limiting of its scope, the invention will be described and explained with additional specificity and detail through the use of the accompanying drawings in which:

FIG. 11 is a side view of embodiment of FIG. 1 showing the device in three successive configurations, (FIG. 11*a*) the ready for maintenance configuration, (FIG. 11*b*) the cutting ready (zero depth) configuration, and (FIG. 11*c*) the cutting at full depth configuration; and FIG. 12 is a side view of another embodiment showing the device in three successive configurations, (FIG. 12*a*) the cutting at full depth configuration, (FIG. 12*b*) the cutting ready (zero depth) configuration, and (FIG. 12*c*) the ready for maintenance configuration.

DETAILED DESCRIPTION OF THE INVENTION

Presently preferred embodiments of the invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the present invention, as represented in the Figures, is not intended to limit the scope of the invention, as claimed, but is merely representative of presently preferred embodiments of the invention.

The word "exemplary" is used exclusively herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

Figures 1, 1A, 1B:
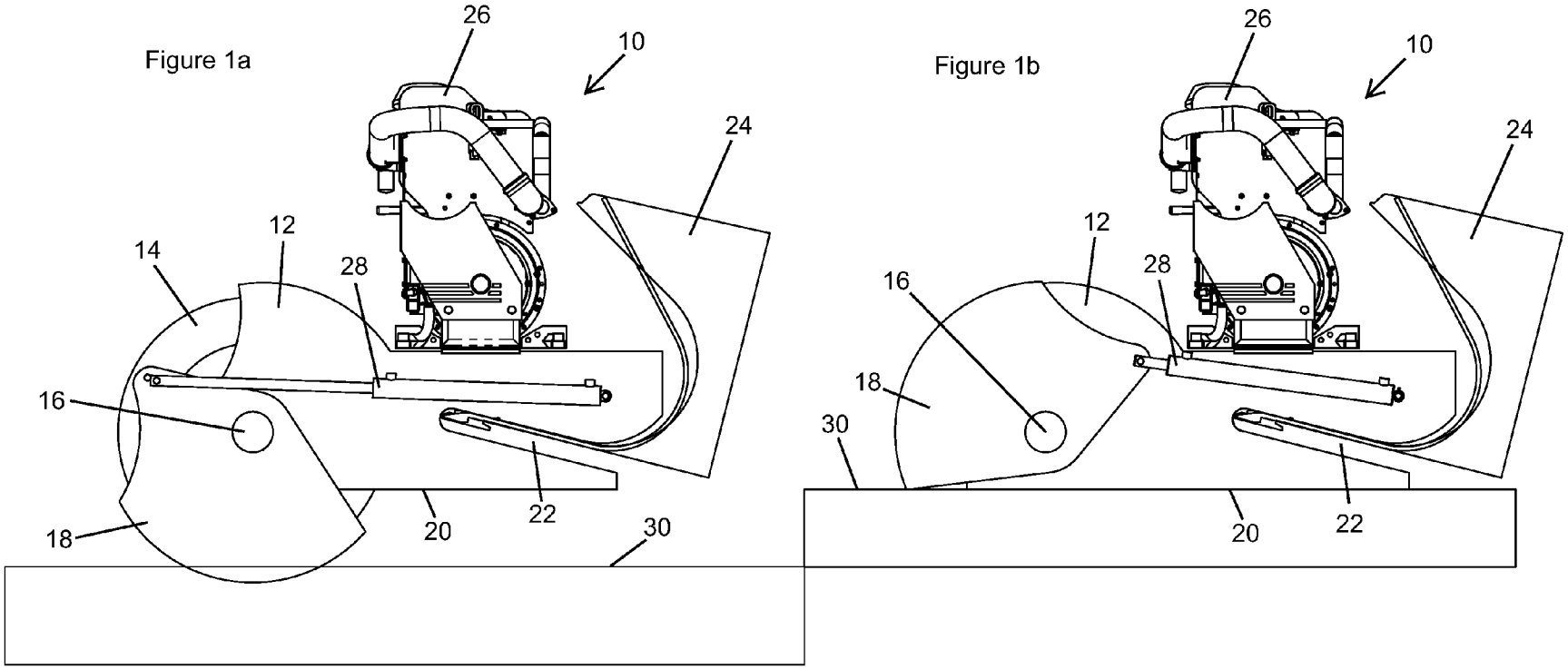
FIG. 1 is a side view of the milling attachment device of the present invention showing the device (FIG. 1*a*) in a ready for maintenance configuration and the device (FIG. 1*b*) in a full depth configuration.

FIG. 1 is a side view of an exemplary embodiment of the milling attachment device 10 of the present invention. FIG. 1*a* shows the milling attachment device 10 in a ready for maintenance configuration and FIG. 1*b* shows the milling attachment device 10 in a full depth configuration. The milling attachment device 10 comprises a frame 12 that supports a cutter head 14 that rotates about an axis 16 and a rotating hood 18 that also rotates about the axis 16. Alternatively, while not shown, the rotating hood 18 may rotate about an axis other than that of the cutter head 14. Frame 12 also has a skid surface 20 and a slot 22 that can receive a loader bucket 24 of a host vehicle (not fully shown) for example. Frame 12 may also support an engine 26 for driving the cutter head 14.

In the embodiment shown in FIG. 1, the rotating hood 18 is rotated about axis 16 by an extending cylinder 28. The extending cylinder 28 may be actuated electrically, hydraulically, pneumatically, or in any other suitable manner. As the extending cylinder 28 extends and retracts, the rotating hood 18 rotates. FIG. 1*a* shows the extending cylinder 28 fully extended and the rotating hood 18 rotated into the ready for maintenance configuration where the rotating hood 18 rests on the ground 30. FIG. 1*b* shows the extending cylinder 28 fully retracted and the rotating hood 18 in a full depth cutting configuration. When the milling attachment device 10 is in the full depth cutting configuration, skid surface 20 may rest on the ground 30 and prevents deeper cutting. Of course, if the extending cylinder 28 is positioned between fully retracted and fully extended, the rotating hood 18 will position accordingly. Hence, there is a position between fully extended and fully retracted where the rotating hood 18 will be rotated to expose the cutter head 14 to the ground 30 but at zero depth. The operator of the milling attachment device 10 can control the cutting depth from that zero depth position to full cutting depth by retracting the extending cylinder 28 the desired increment that corresponds to the desired cutting depth.

The milling attachment device 10 can be maneuvered into position by any suitable host vehicle, such as a back hoe, a loader, an excavator, a track hoe, a skid steer, or the like. Although the host vehicle is not fully shown, a loader bucket 24 of a host vehicle is shown to illustrate how the milling attachment device 10 can be captured by the loader bucket 24 and lifted or steered by the host vehicle (not shown). By inserting the loader bucket 24 into the slot 22, the frame 12 is captured and can be maneuvered by the host vehicle. Of course, a person of skill in the art will be familiar with many more ways that the milling attachment device 10 can be captured and steered, by way of example, any of a number of known attachments could be used such as quick connects of the JRB style, skid steer, or balderson style.

Although each of the figures illustrate an engine 26 mounted on the frame 12, it should be understood that the milling attachment device 10 could be powered by the host vehicle. In that case, an engine 26 need not be used and a drive mechanism would instead be used to transfer power from the host vehicle to the milling attachment device 10.

Figure 2:
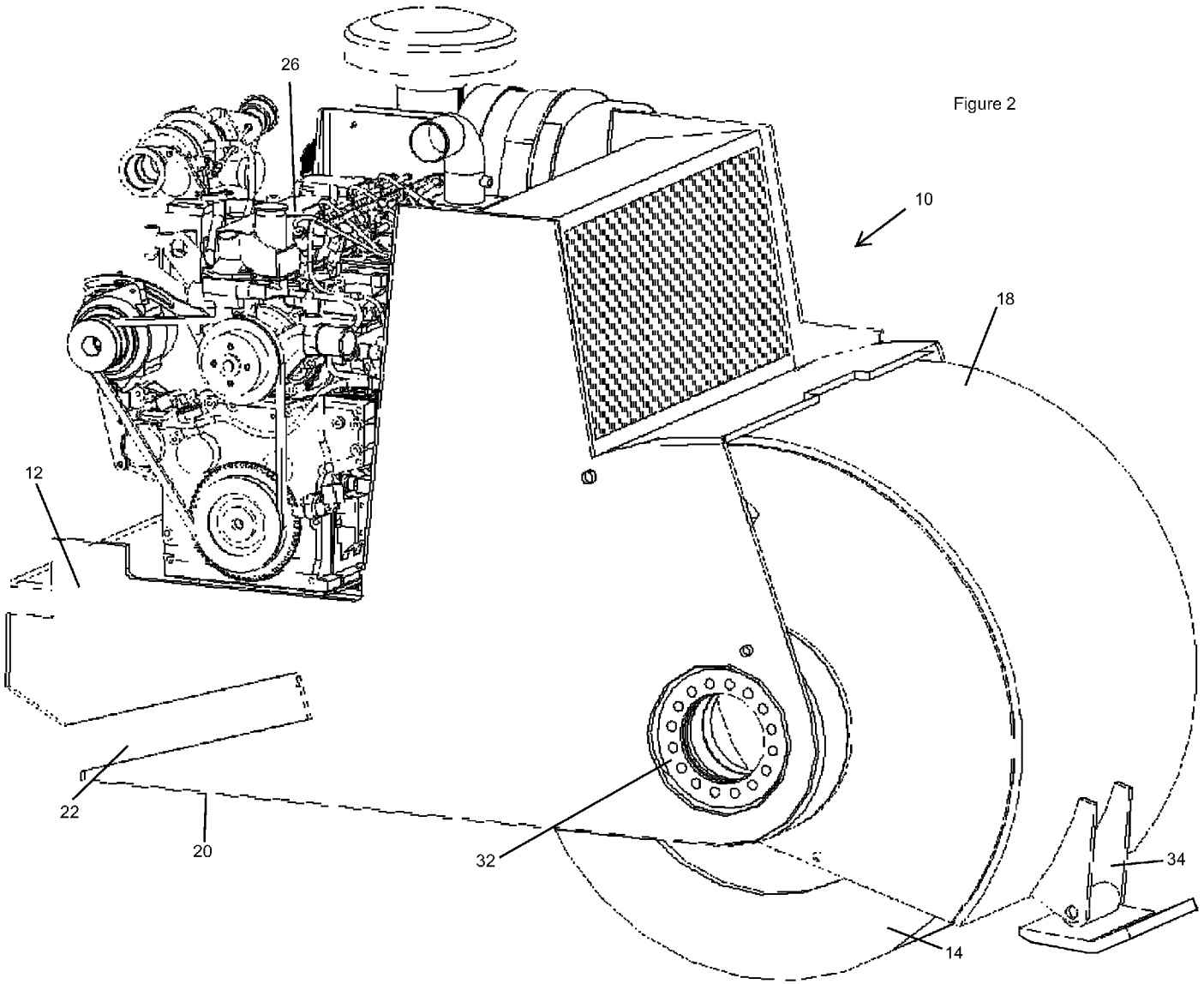
FIG. 2 is a perspective view of another embodiment of the milling attachment device of the present invention.

Referring now to FIG. 2, another embodiment of the milling attachment device 10 of the present invention is shown. This embodiment differs from that shown in FIG. 1 in that a slew drive 32 is used to rotate the rotating hood 18 rather than an extending cylinder 28. The slew drive 32 can rotate the rotating hood 18 through at least the same range of rotation as described above.

Further, this embodiment shows the rotating hood 18 positioned inside the frame 12 whereas the embodiment of FIG. 1 shows the rotating hood 18 positioned outside the frame 12. Either position of the rotating hood 18 is within the scope of the conceived embodiments.

Additionally, in the embodiment of FIG. 2 the rotating hood 18 has a skid foot 34 disposed near its forward end. This skid foot 34 may pivot or not pivot as desired, or may be selectively enabled to pivot or not pivot. The purpose of the skid foot 34 is to act as a buffer to hold the leading edge of the rotating hood 18 slightly above contact with the ground 30 as the skid foot 34 traverses the ground 30. This will prevent the leading edge from being damaged.

Figure 3:
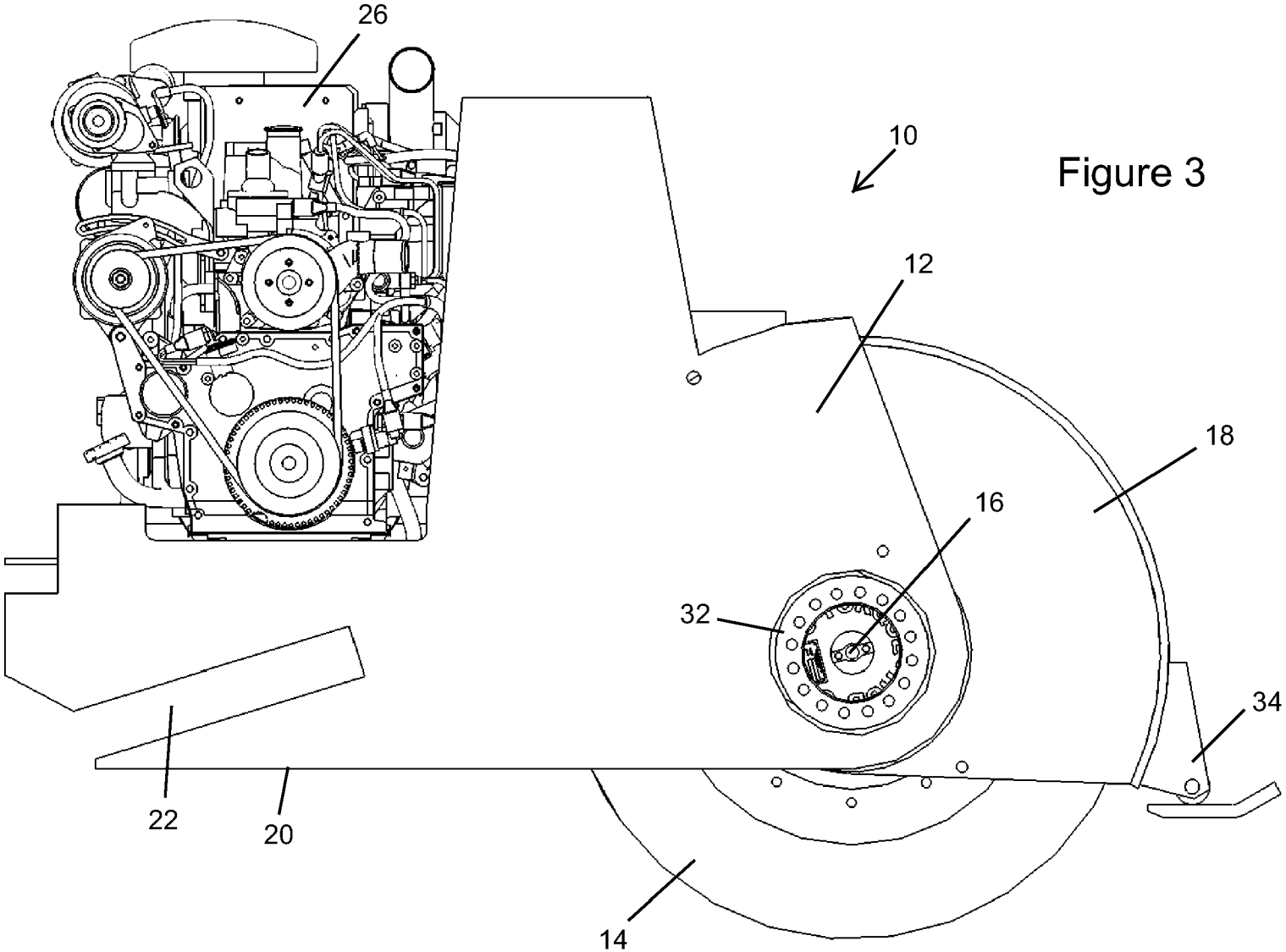
FIG. 3 is a side view of the embodiment of FIG. 2 showing the device in a full depth configuration.

FIG. 3 is a side view of the embodiment of FIG. 2 showing the milling attachment device 10 in a full depth configuration. In this configuration, the rotating hood is rotated such that the skid surface 20, the leading edge of the rotating hood 18, and the skid foot 34 generally align so that the maximum cutting depth is achieved by the cutting head 14.

Figure 4:
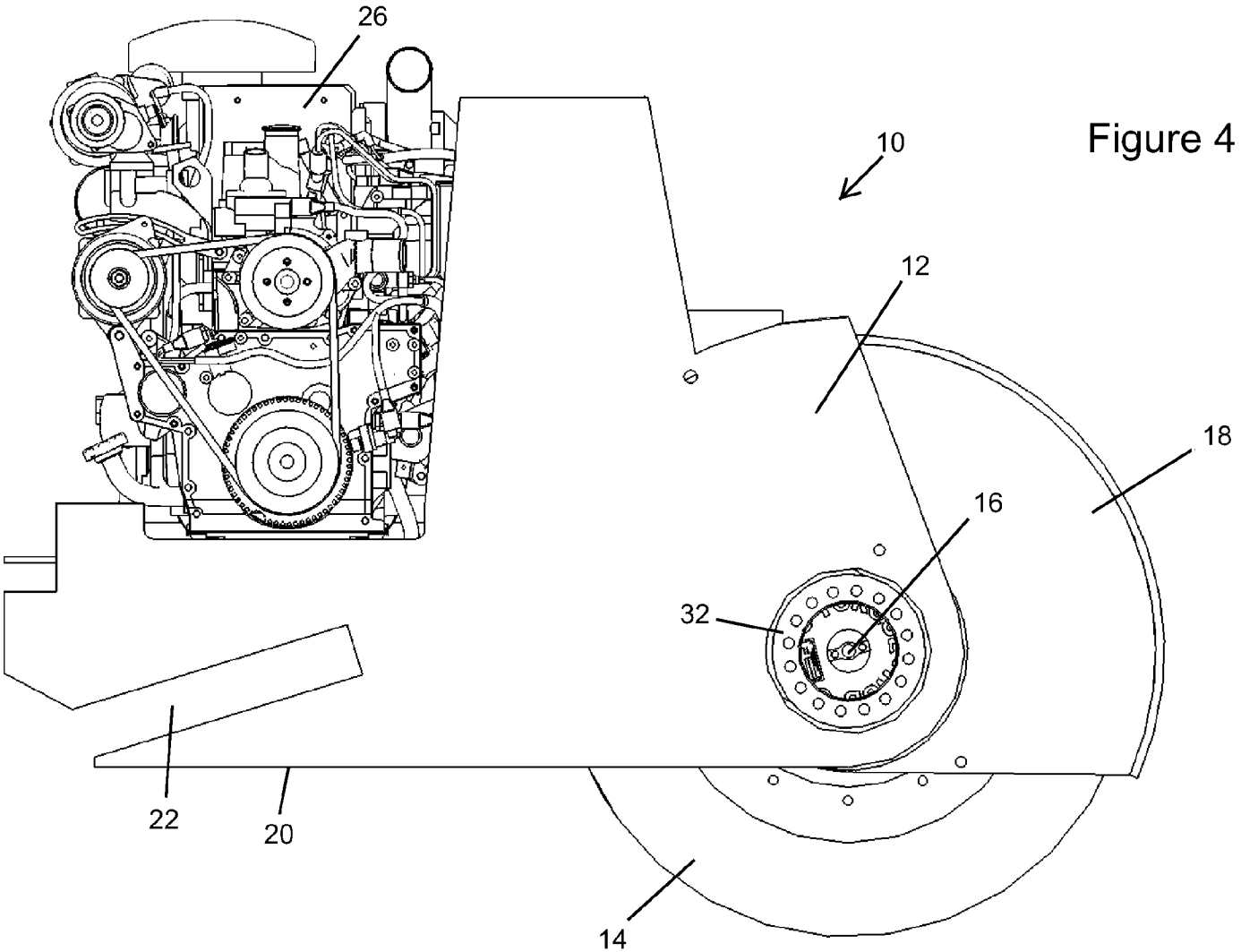
FIG. 4 is a side view of the embodiment of FIG. 2 showing the device in a full depth configuration with the skid foot removed.

FIG. 4 is a side view of yet another embodiment showing the slew drive device of FIG. 2 in a full depth configuration, but without a skid foot 34. In this configuration, the rotating hood 18 is rotated such that the skid surface 20 and the leading edge of the rotating hood 18 generally align so that the maximum cutting depth is achieved by the cutting head 14.

Figure 5:
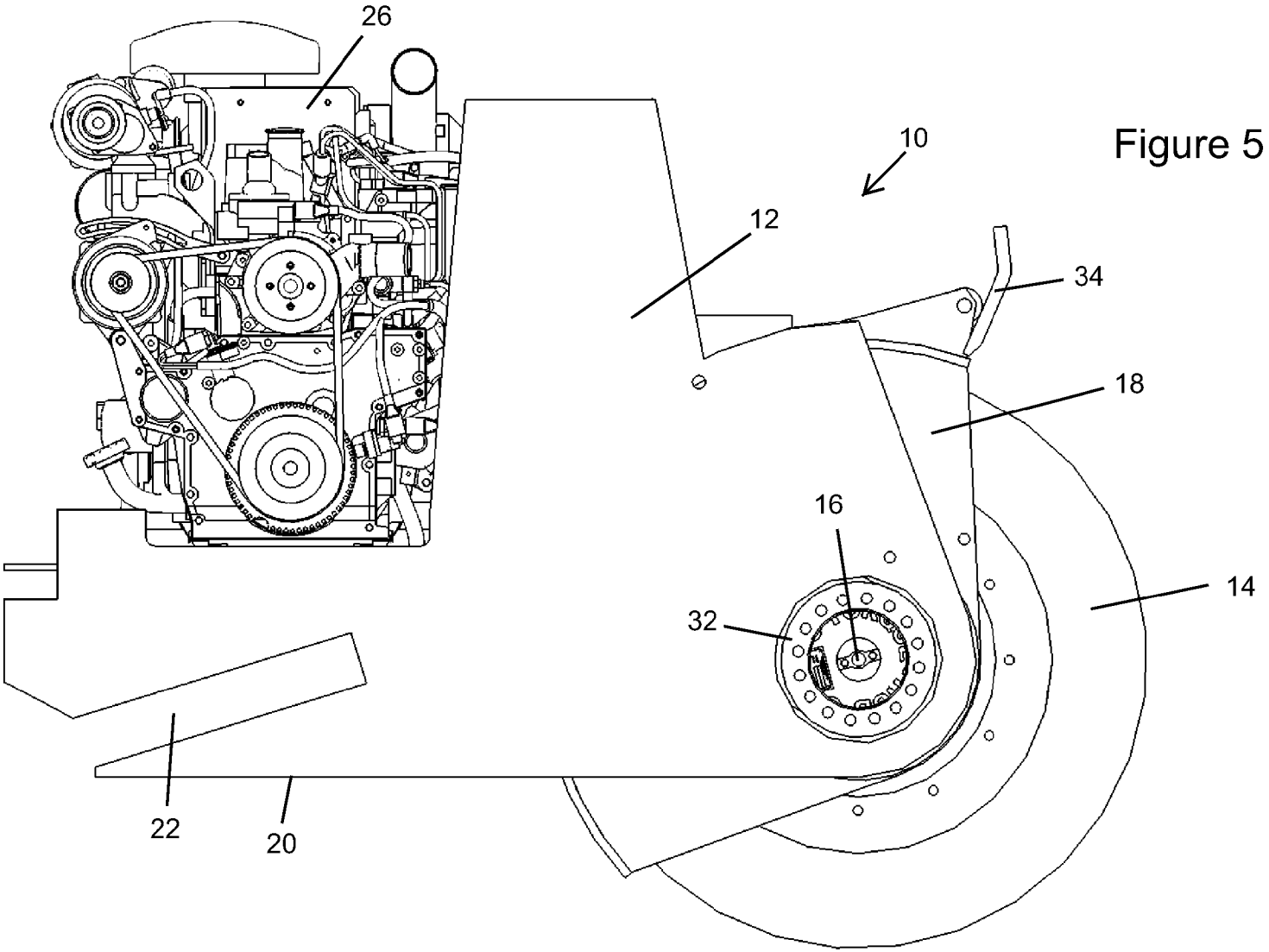
FIG. 5 is a side view of the embodiment of FIG. 2 showing the device open for full bit access.

FIG. 5 is a side view of the embodiment of FIG. 2 showing the milling attachment device 10 open for full bit access with the rotating hood 18 rotated to fully expose the cutting head 14. In this configuration, the rotating hood 18 is fully rotated into the frame 12 so that the maximum amount of the cutting head 14 is exposed for access.

Figure 6:
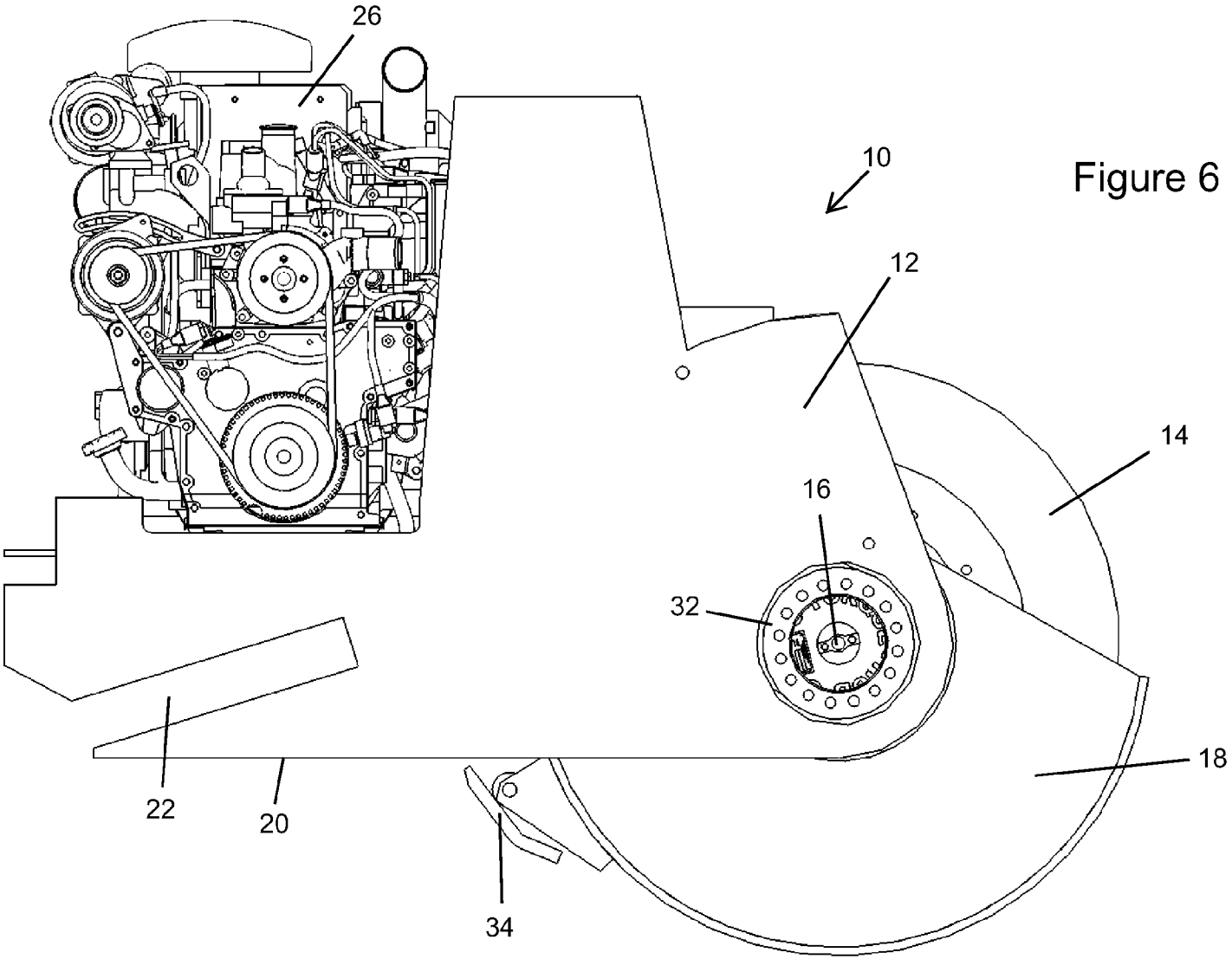
FIG. 6 is a side view of the embodiment of FIG. 2 showing the device open for bit access and resting on the rotating hood.

FIG. 6 is a side view of the embodiment of FIG. 2 showing the milling attachment device 10 open for bit access. In this configuration, the rotating hood 18 is fully rotated the opposite direction from the configuration in FIG. 5 so that the rotating hood 18 rests on the ground supporting the milling attachment device 10 and the cutting head 14 is exposed for access. Because the cutting head 14 does not support the milling attachment device 10, the cutting head is free to rotate so that all of the cutting teeth can be accessed.

Figure 7:
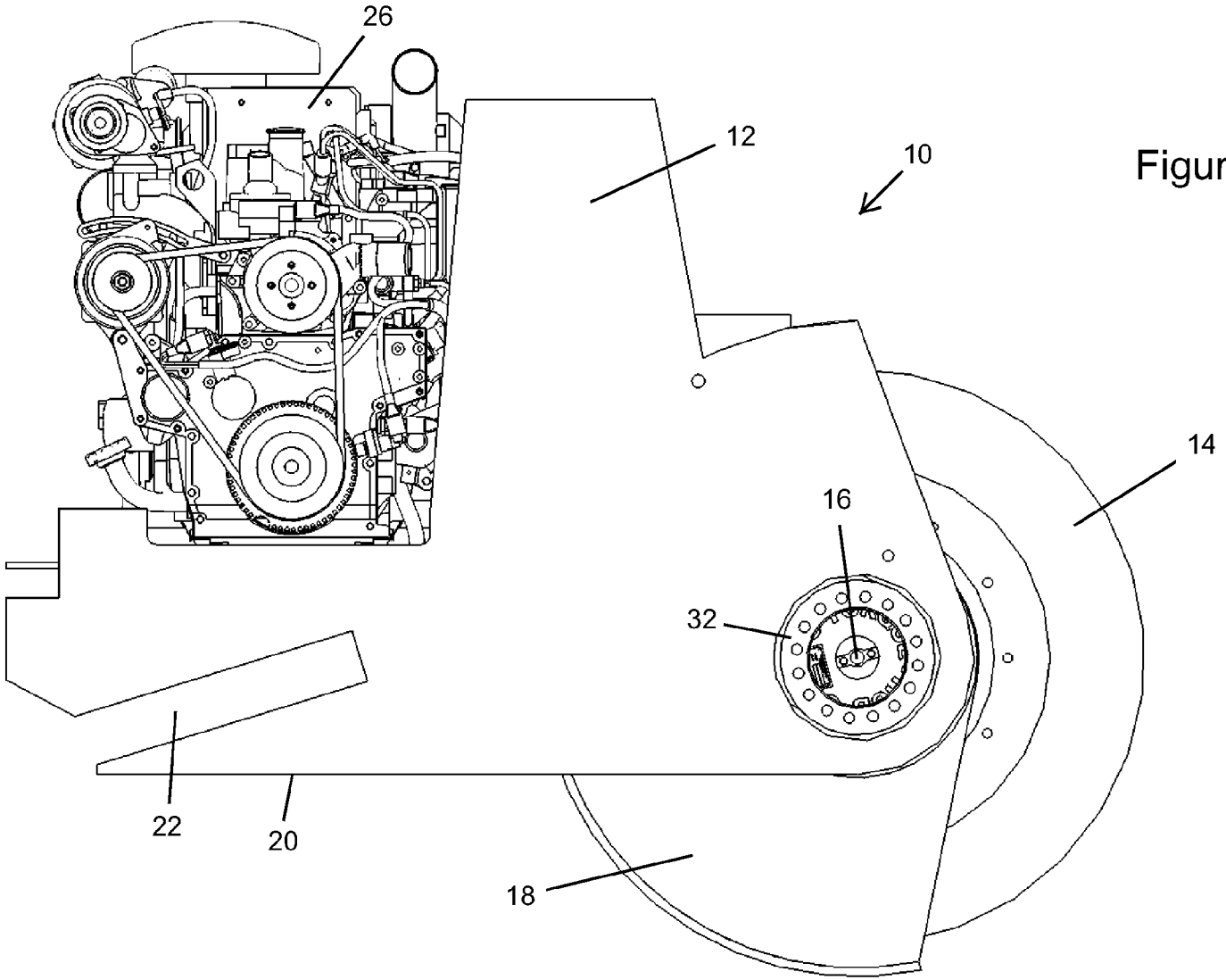
FIG. 7 is a side view of the embodiment of FIG. 4 (skid foot removed) showing the device open for bit access and resting on the rotating hood.

FIG. 7 is a side view of the embodiment of FIG. 4 showing the milling attachment device 10 open for bit access. In this configuration, the rotating hood 18 is rotated so that the rotating hood 18 rests on the ground thereby supporting the milling attachment device 10 and the cutting head 14 is exposed for access. Because the cutting head 14 does not support the milling attachment device 10, the cutting head 14 is free to rotate so that all of the cutting teeth can be accessed.

Figure 8:
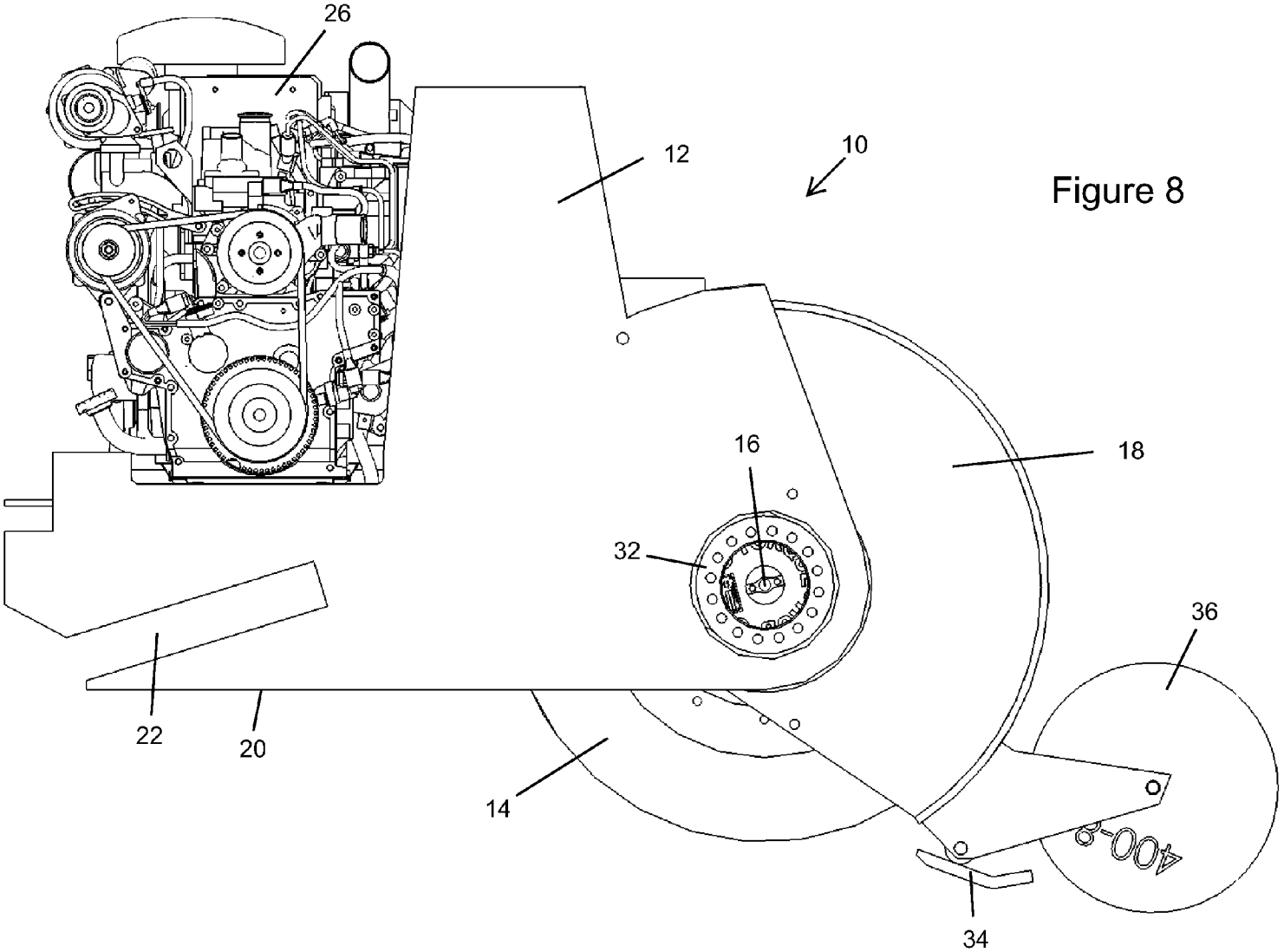
FIG. 8 is a side view of yet another embodiment showing the device with both a skid foot and a wheel and configured at zero depth.

FIG. 8 is a side view of another exemplary embodiment showing the milling attachment device 10 with a skid foot 34 and a wheel 36. In the configuration illustrated, the rotating hood 18 is rotated so that the skid foot 34 and wheel 36 contacts the ground while the cutting head 14 is exposed but held slightly above the ground. This holds the cutting head 14 at the zero depth configuration.

Figure 9:
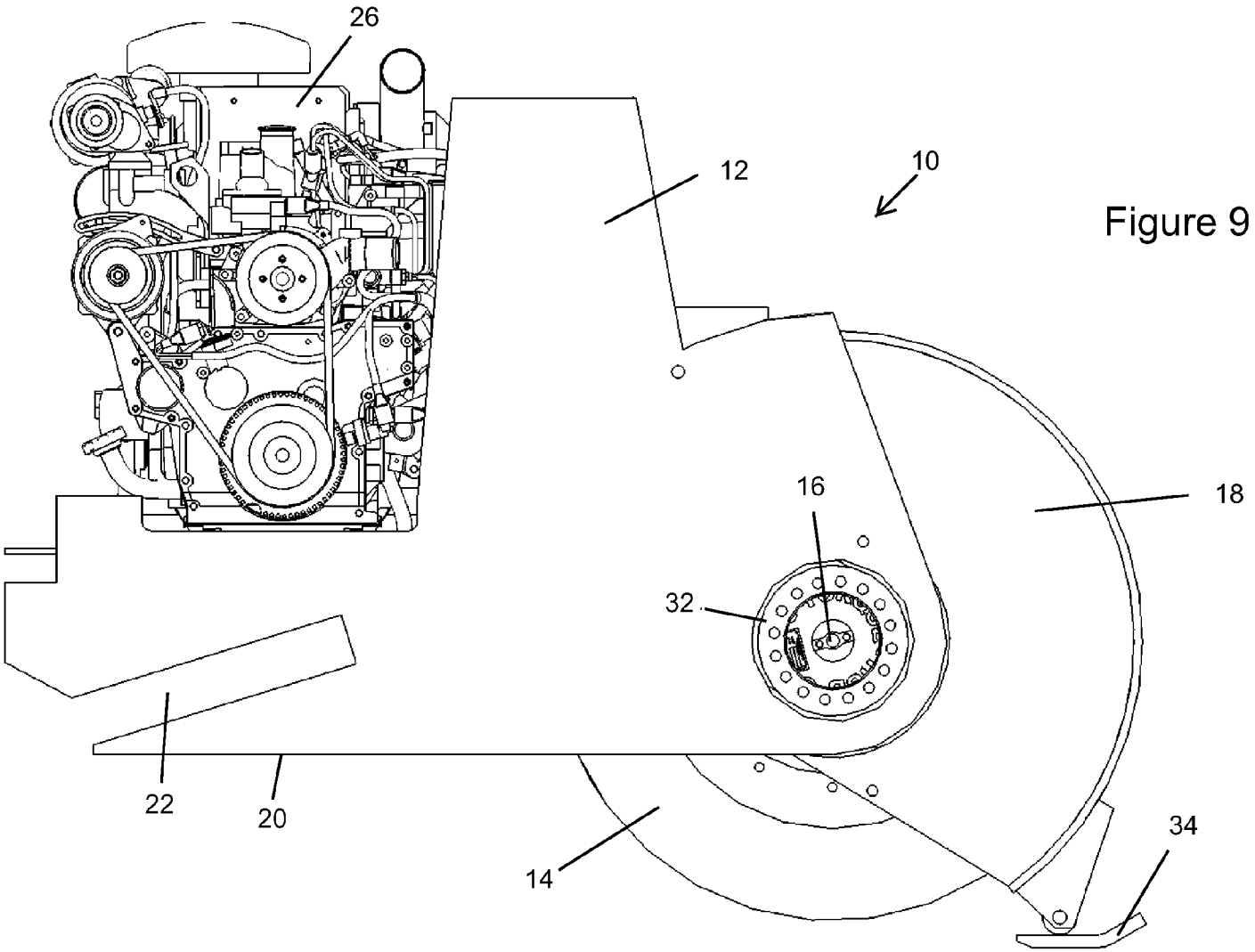
FIG. 9 is a side view of the embodiment of FIG. 2 showing the device without a wheel in a zero depth configuration.

FIG. 9 is a side view of the embodiment of FIG. 2 showing the milling attachment device 10 with the skid foot 34 positioned to hold the cutting head 14 at zero depth. In this configuration, the rotating hood 18 is rotated so that the skid foot 34 contacts the ground while the cutting head 14 is exposed but held slightly above the ground.

Figure 10:
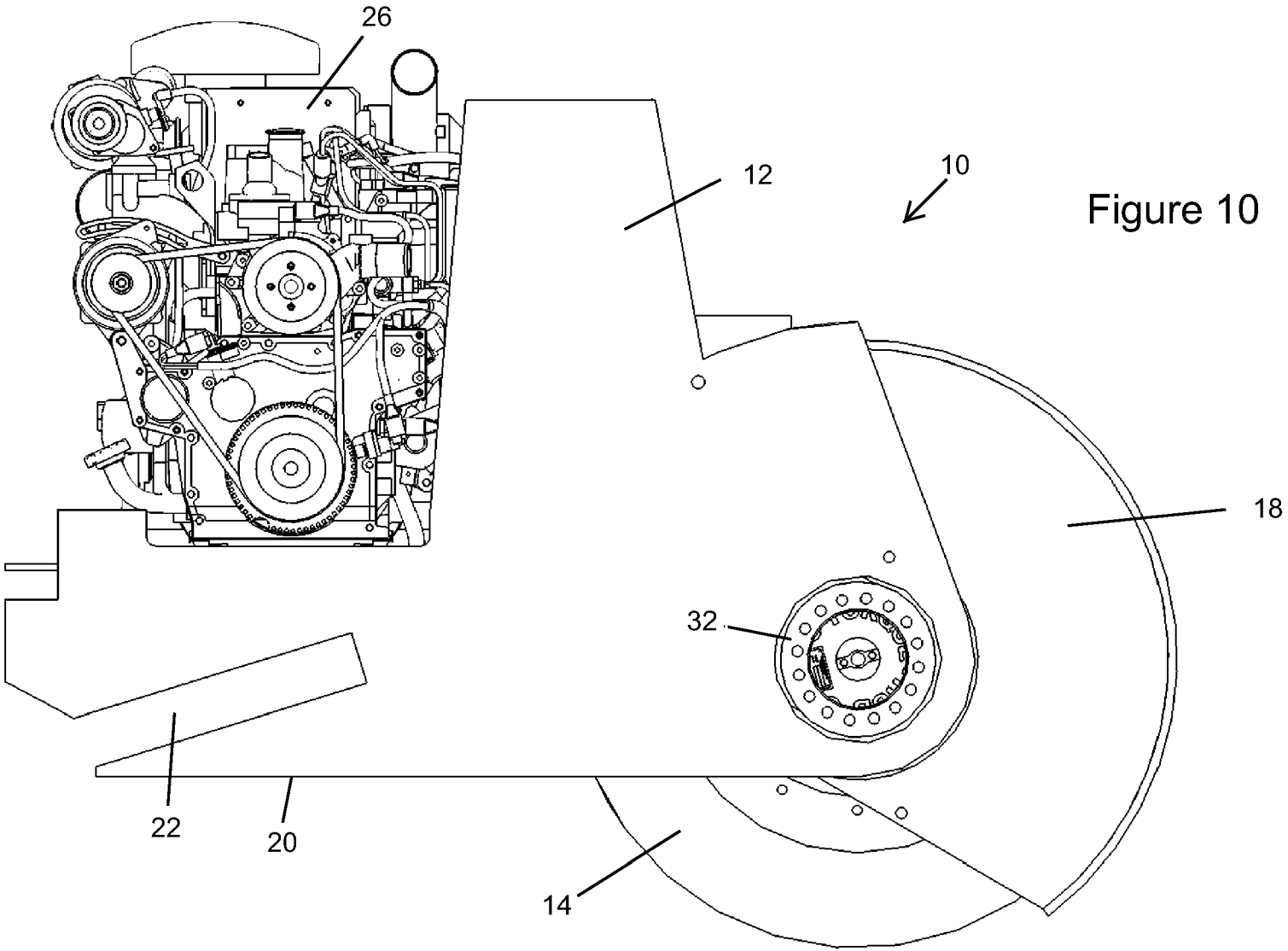
FIG. 10 is a side view of the embodiment of FIG. 4 (skid foot removed) showing the device in a zero depth configuration.

FIG. 10 is a side view of the embodiment of FIG. 4 showing the milling attachment device 10 with the rotating hood 18 positioned to hold the cutting head 14 at zero depth. In this configuration, the rotating hood 18 is rotated so that its leading edge contacts the ground while the cutting head 14 is exposed but held slightly above the ground.

FIG. 11 is a series of side views of the milling attachment device 10 of FIG. 1 showing the movement of the extending cylinder 28 from the fully extended ready for maintenance configuration (FIG. 11*a*) to the partially retracted cutting ready configuration (FIG. 11*b*) to the fully retracted cutting at full depth configuration (FIG. 11*c*). Of course, a person of ordinary skill in the art would understand that cutting depth control is accomplished by retracting the extending cylinder 28 to the corresponding desired cutting depth between the cutting ready configuration of FIG. 11*b* and the full depth configuration of FIG. 11*c*. Such cutting depths are adjustable by adjusting the extent of the retraction or extension of the extending cylinder 28. FIG. 11 also shows exemplary individual bits 38 as attached to the cutting head 14. FIG. 11*a* illustrates the area of the cutting head 14 exposed in the ready for maintenance configuration. As shown, 84.2° of the cutting head 14 surface is exposed when the rotating shield 18 is in the ready for maintenance configuration. Because the milling attachment device 10 is supported by the rotating hood 18 the cutting head 14 can be easily rotated to expose further cutting head 14 surface area. In a combination of just over four positions, the entire cutting head surface can be exposed allowing all of the bits to be maintained.

Similar to FIG. 11, FIG. 12 is a series of side views of yet another embodiment of the milling attachment device 10 showing the connection of the extending cylinder 28 to linkage 40 and the movement of the extending cylinder 28 and linkage 40 from the fully retracted cutting at full depth configuration (FIG. 12*a*), to the partially extended cutting ready (zero depth) configuration (FIG. 12*b*), to the fully extended ready for maintenance configuration (FIG. 11*c*). Again, a person of ordinary skill in the art would understand that cutting depth control is accomplished by retracting the extending cylinder 28 to the corresponding desired cutting depth between the cutting ready configuration of FIG. 12*b* and the full depth configuration of FIG. 12*a*. Such cutting depths are adjustable by adjusting the extent of the retraction or extension of the extending cylinder 28.

Those skilled in the art will appreciate that the present embodiments are exemplary only and that any of a number of ways may be used to rotate a rotating hood 18 to accomplish both depth control and bit access. Also, the axis 16 of the cutting head 14 need not be the same as the axis of rotation for the rotating hood 18.

Referring to all of the Figures collectively, the present embodiments also relate to a method for maintaining a cutting head 14 of a milling attachment device 10. The method comprises a series of acts. The rotating hood 18 of a milling attachment device 10 is positioned such that the rotating hood 18 supports the milling attachment device 10 thereby allowing the cutting head 14 to rotate freely. The bits of the exposed surface of the cutting head 14 are then maintained, which may include replacing the bits 38. The cutting head 14 is then rotated to expose a new section of the cutting head 14 for maintenance. Upon the completion of the maintenance of the cutting head 14, the rotating hood 18 is positioned such that the cutting head 14 is ready to cut at a desired depth.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A milling attachment device having a range of cutting ready configurations and a maintenance ready configuration, the milling attachment device for attachment to a host vehicle comprising:

a frame for receiving the host vehicle and supporting a cutting head;

a rotating hood for rotation about the cutting head, wherein the hood can be rotated so that some portion of the hood is located directly beneath the cutting head axis and cutting head in the maintenance ready configuration while the device is upright to support a substantial portion of the weight of the frame; and an actuating mechanism for rotating the rotating hood.

2. A milling attachment device as in claim 1 wherein the rotating hood can be rotated into a configuration from among the range of the cutting ready configurations for zero depth milling.

3. A milling attachment device as in claim 1 wherein the rotating hood can be rotated into a configuration from among the range of the cutting ready configurations for full depth milling.

4. A milling attachment device as in claim 1 wherein cutting depth control is accomplished by rotating the rotating hood through the range of cutting ready configurations to a configuration for a desired depth between zero depth and full depth.

5. A milling attachment device as in claim 1 wherein the actuating mechanism is an extending cylinder.

6. A milling attachment device as in claim 1 wherein the actuating mechanism is a slew drive.

7. A milling attachment device as in claim 1 wherein the actuating mechanism comprises an extending cylinder and linkage.

8. A milling attachment device as in claim 1 further comprising:

a cutting head supported by the frame; and a drive mechanism for causing the cutting head to rotate relative to the frame.

9. A milling attachment device as in claim 8 wherein the drive mechanism is powered by the host vehicle.

10. A milling attachment device as in claim 8 wherein the drive mechanism is an engine mounted on the frame.

11. A milling attachment device as in claim 1 wherein the cutting head rotates freely when the milling attachment device is in the maintenance ready configuration.

12. A milling attachment device for attachment to a host vehicle comprising:

a frame for receiving the host vehicle and supporting a cutting head that rotates about an axis;

a rotating hood for rotation about the cutting head, wherein the hood can be rotated so that some portion of the hood is located directly beneath the cutting head axis and cutting head in a maintenance ready configuration while the device is upright to support the frame such that the cutting head may rotate freely;

an actuating mechanism for rotating the rotating hood; and a drive mechanism for rotating the cutting head about the axis.

13. A milling attachment device as in claim 12 wherein the rotating hood rotates about the cutting head axis.

14. A milling attachment device as in claim 12 wherein the rotating hood rotates about an axis other than the cutting head axis.

15. The milling attachment device as in claim 12 further comprising a wheel attached to a leading edge of the rotating hood.

16. The milling attachment device as in claim 12 further comprising a skid foot attached to a leading edge of the rotating hood.

17. A method for configuring a milling attachment device to accommodate maintenance and cutting, the method comprising the acts of:

rotating a rotating hood of the milling attachment device such that some portion of the hood is located directly beneath the cutting head axis and cutting head while the device is upright to support a frame of the milling attachment device, thereby allowing a cutting head to rotate freely;

maintaining an exposed surface of the cutting head to accommodate maintenance;

rotating the cutting head to expose a new surface for maintenance; and rotating the hood to lower the cutting head to cut at a desired depth.

* * * * *